US007296699B2

(12) United States Patent
Hung et al.

(10) Patent No.: US 7,296,699 B2
(45) Date of Patent: Nov. 20, 2007

(54) STRUCTURE OF DISPLAY RACK

(76) Inventors: Ming-Chun Hung, PO Box 82-144, Taipei (TW); Hao-Yun Hung, PO Box 82-144, Taipei (TW)

( * ) Notice: Subject to any disclaimer, the term of this patent is extended or adjusted under 35 U.S.C. 154(b) by 427 days.

(21) Appl. No.: 11/020,150

(22) Filed: Dec. 27, 2004

(65) Prior Publication Data

US 2006/0138066 A1 Jun. 29, 2006

(51) Int. Cl.
*A47B 43/00* (2006.01)

(52) U.S. Cl. ..... 211/189; 211/200; 211/182

(58) Field of Classification Search ..... 211/189, 211/200, 201, 182, 194; 248/164, 431, 150, 248/163.1, 165–167, 434–436; 108/118; 52/646, 645, 651.1; 135/131, 144, 145, 147, 135/157, 159

See application file for complete search history.

(56) References Cited

U.S. PATENT DOCUMENTS 3,354,598 A * 11/1967 Schafer ..... 52/646
5,327,700 A * 7/1994 Sorenson et al. ..... 52/109
5,645,259 A * 7/1997 Chen ..... 248/436
6,161,359 A * 12/2000 Ono ..... 52/651.1
6,499,705 B1 * 12/2002 Tsai ..... 248/167
6,799,594 B2 * 10/2004 Kuo ..... 135/147
6,877,622 B2 * 4/2005 Tsai ..... 211/195
2004/0051009 A1 * 3/2004 Chen ..... 248/163.1

* cited by examiner

*Primary Examiner*—Jennifer E. Novosad
(74) *Attorney, Agent, or Firm*—Leong C. Lei

(57) ABSTRACT

A structure of a display rack which includes a plurality of main beams, connecting sockets, diagonal support beams, and extension sockets, characterized in that the main beam is of pre-defined length, the connecting socket is movable along the main beam, the diagonal support beam is installed in slots formed by the fins of the connecting sockets, and the slots are used for the attachment of face plates.

1 Claim, 10 Drawing Sheets

STRUCTURE OF DISPLAY RACK

BACKGROUND OF THE INVENTION (a) Technical Field of the Invention

The present invention generally relates to display racks that are to be assembled on the field, and more particularly to a flexible, highly efficient, and easy to assemble display rack structure used in show room or exhibition hall.

(b) Description of the Prior Art

Many businesses in their show rooms and/or exhibition halls use temporary structures such as display racks and/or frames for their mobility and functionality. These structures are designed for easy assembly to achieve flexibility and convenience in transportation and storage.

Most of these designs use a few basic types of beams that can be put together easily. To obtain the necessary strength of the finished structure, the construction is usually consisted of two or more main beams connected with several connecting or supporting beams in between. The disadvantages of prior arts are:

First, traditionally these supporting beams are welded together. Although welding makes a strong connection, the bulky structure makes them difficult to transport and store.

Secondly, to meet different configuration and strength requirements, many types and sizes of beams are needed resulting in cumbersome stocking and material management operation.

Thirdly, to avoid the problems created by welding connection, some manufacturers also provide screws and bolts type of connections which use ball-shaped connectors to put together extension beams. This type of structure has the advantage of easy assembly but at the expense of labor extensive and time consuming operations in the field. Again, it has the disadvantage of stocking many types of beams to meet different configuration requirements.

Fourthly, on top of these, the prior arts use screws and press-fit gadgets to fasten face-plates for marking and description of goods displayed onto the displaying racks. These steps are also labor extensive and time consuming.

Therefore, there is indeed a need for simplified structure that can provide flexible rack configuration, convenient assembling method, and easy attachment of accessories such as face-plates. This invention offers an innovated design meets all these desired features.

SUMMARY OF THE INVENTION

The primary purpose of the present invention is to provide an improved structure of assembled display rack construction. In this invention, the main mechanical structure comprises two or more main beams with pre-defined length, embedded connecting sockets movable vertically on the main beam, diagonal support beams to be installed on the main beams using the connecting sockets, and other required accessories.

The main design feature of this invention is that the connecting socket has U-shaped slots formed by built-in parallel flanges for installation of the diagonal support beams and face-plates required.

From the description of the mechanical structure and associated operational characteristics, the present innovative design provides flexibility in the number of and space between main beams as well as means of adding support beams and face-plates. This invention has the additional advantage of adding extension sockets at the end of each main beam, so the structure can be repeated to fill the required space and display need.

The foregoing and other objects, features, aspects and advantages of the present invention will become better understood from a careful reading of a detailed description provided herein below with appropriate reference to the accompanying drawings.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

In the following, detailed description along with the accompanied drawings explains fully the preferred embodiments of the present invention.

Figure 1:
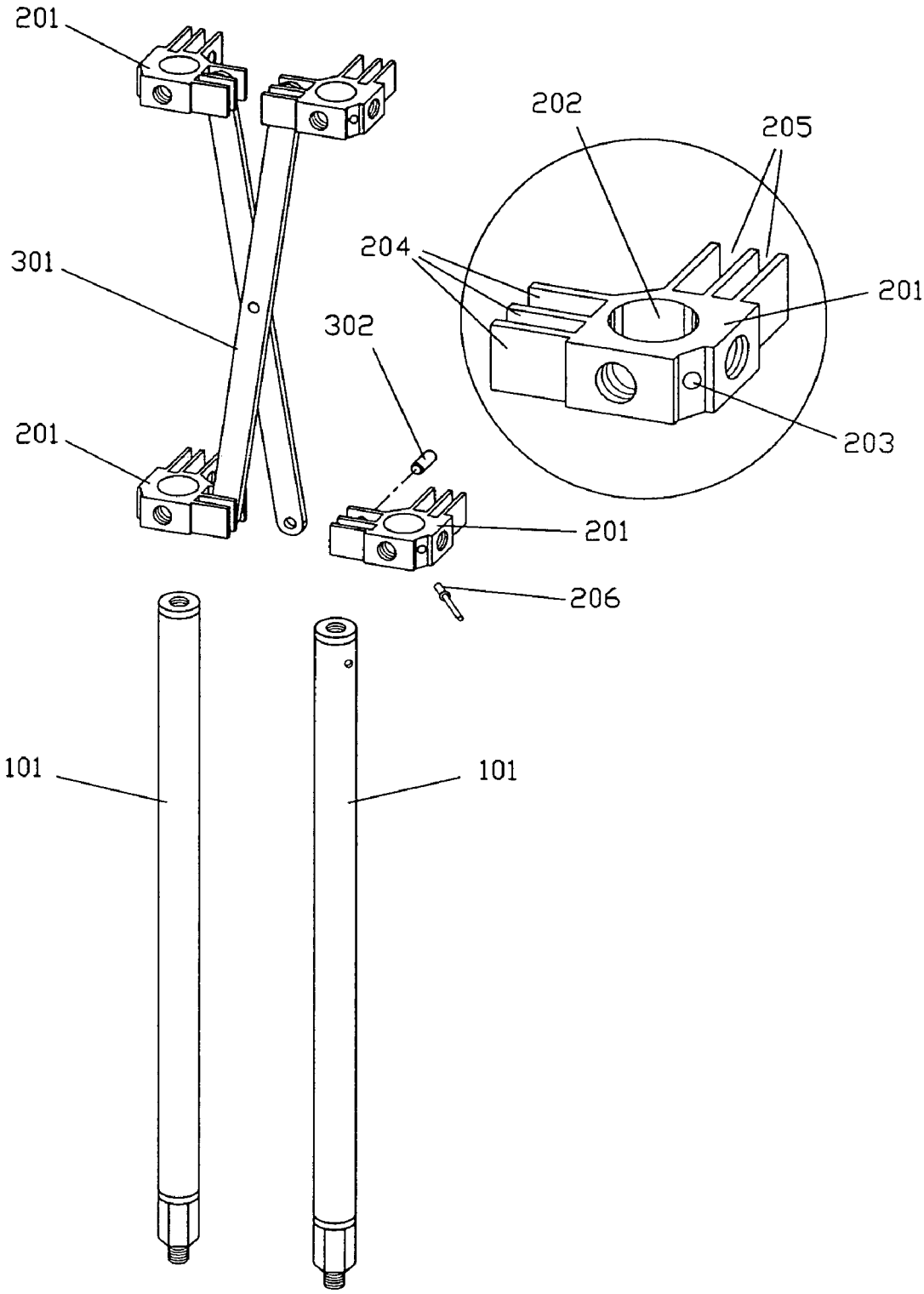
FIG. 1 is a three-dimensional sectional view of the present invention.

As shown in FIG. 1, this invention is a beam structure for assembled display rack. The embodiment of the present invention comprises main beams 101, connecting sockets 201, and diagonal support beams 301. The embodiment will take at least two main beams which are shallow cylinder with pre-defined length, several connecting sockets, and a number of diagonal support beams as required. The diagonal support beam 301 is a set of two beams fastened at the center using a pivotal connection, so the two beams can be in either an open or a close configuration. The connecting socket 201 has an insertion hole 202 in the center of its body, so the main beam 101 can be put trough the insertion hole, and the socket 201 can be moved vertically along the main beam 101 for the suitable location. The connecting socket 201 also has a fastening hole 203 used to attach the connecting socket 201 firmly at the desired location on the main beam. The connecting socket 201 is provided with three fins 204 at one side to form two slots 205 and a plurality of fins 204 at an adjacent side to form two slots 205.

Figure 3:
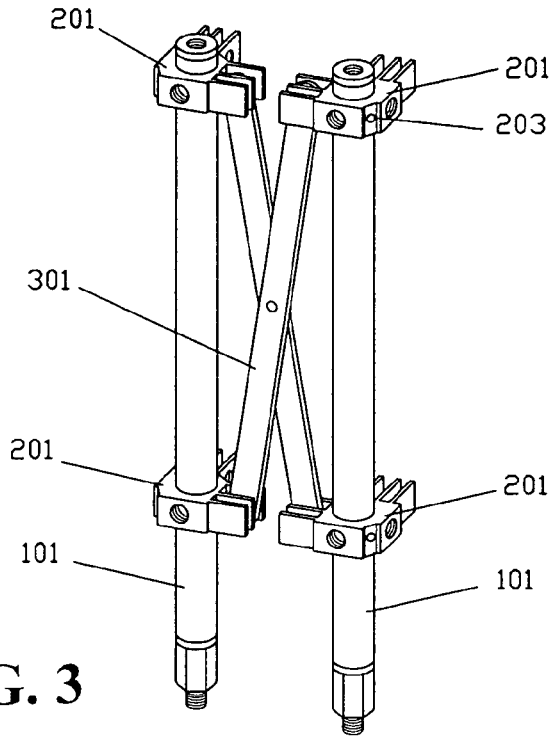
FIG. 3 is a view showing the present invention in closed position.

FIG. 1 and FIG. 3 show how the diagonal support beams 301 are installed on the flanges with the fastening bolt 302 inside the slot 205. The main beams 101 are inserted into the connecting socket 201 and fastened with blind rivets 206. This completes the basic structure of the present embodiment.

Figure 2:
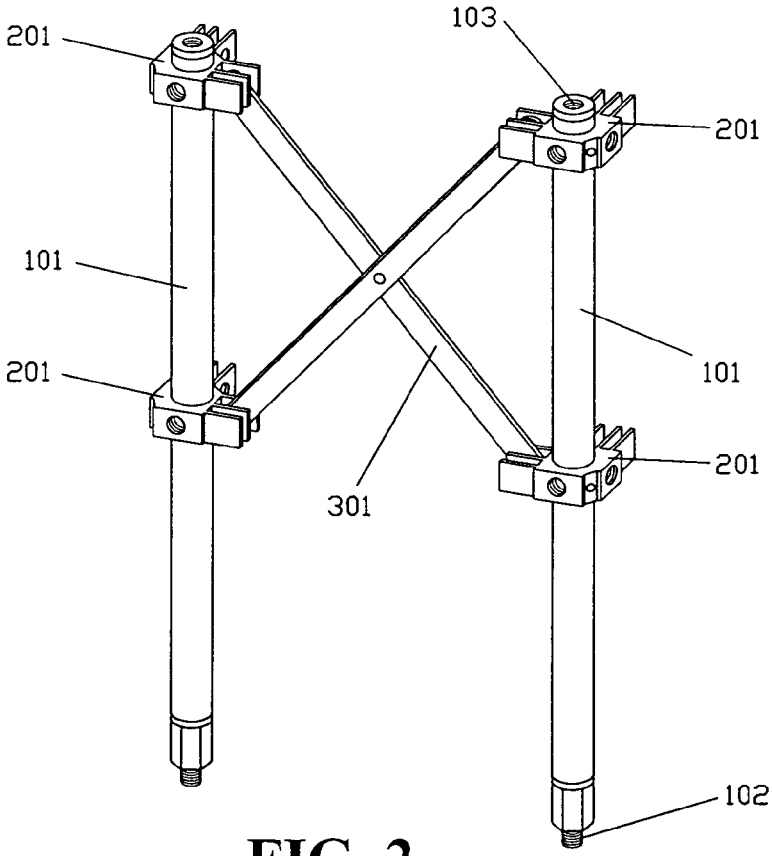
FIG. 2 is a view showing expanded assembly of the present invention.
Figure 4:
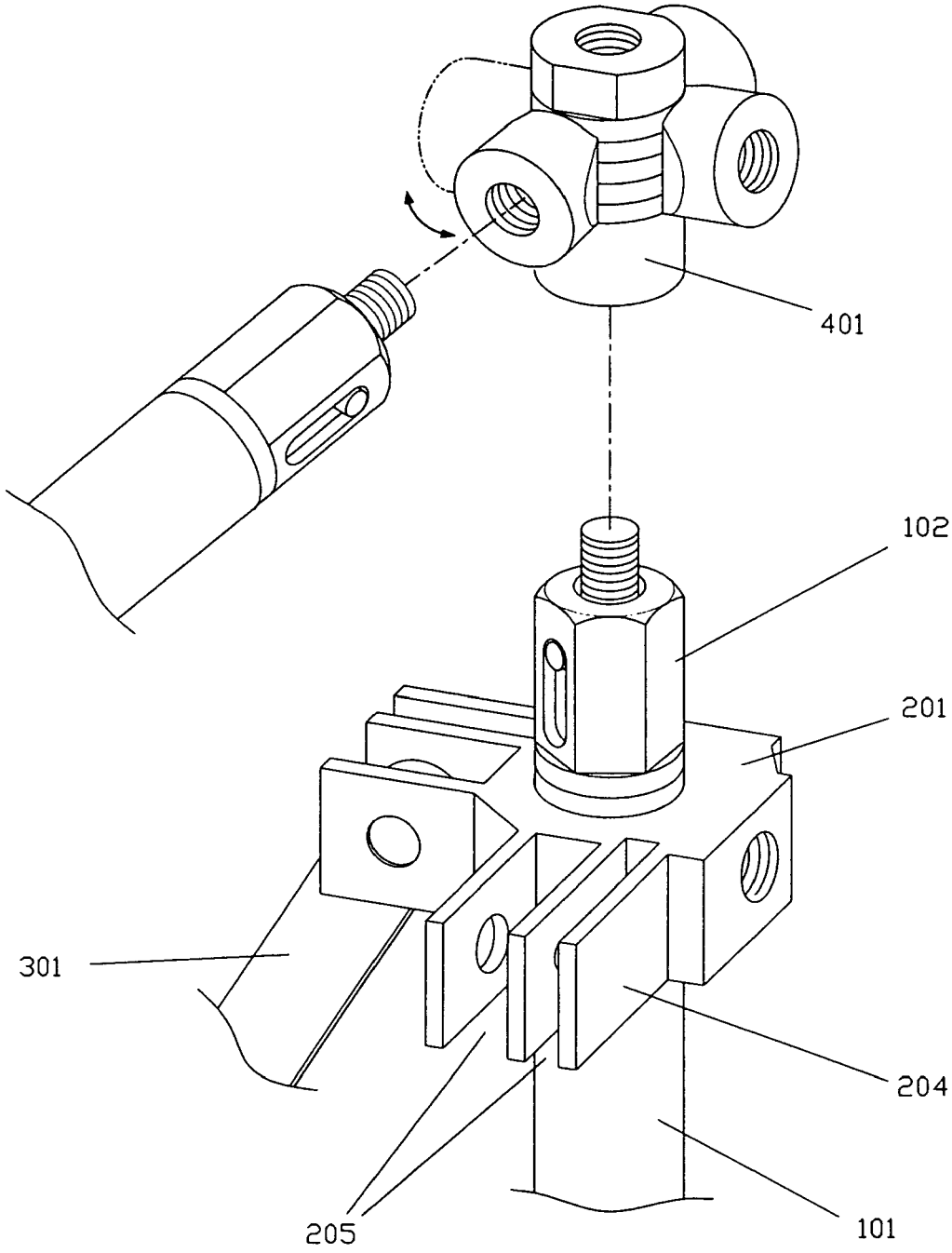
FIG. 4 is a sectional view showing partial structure of the embodiment of the present invention.
Figure 7:
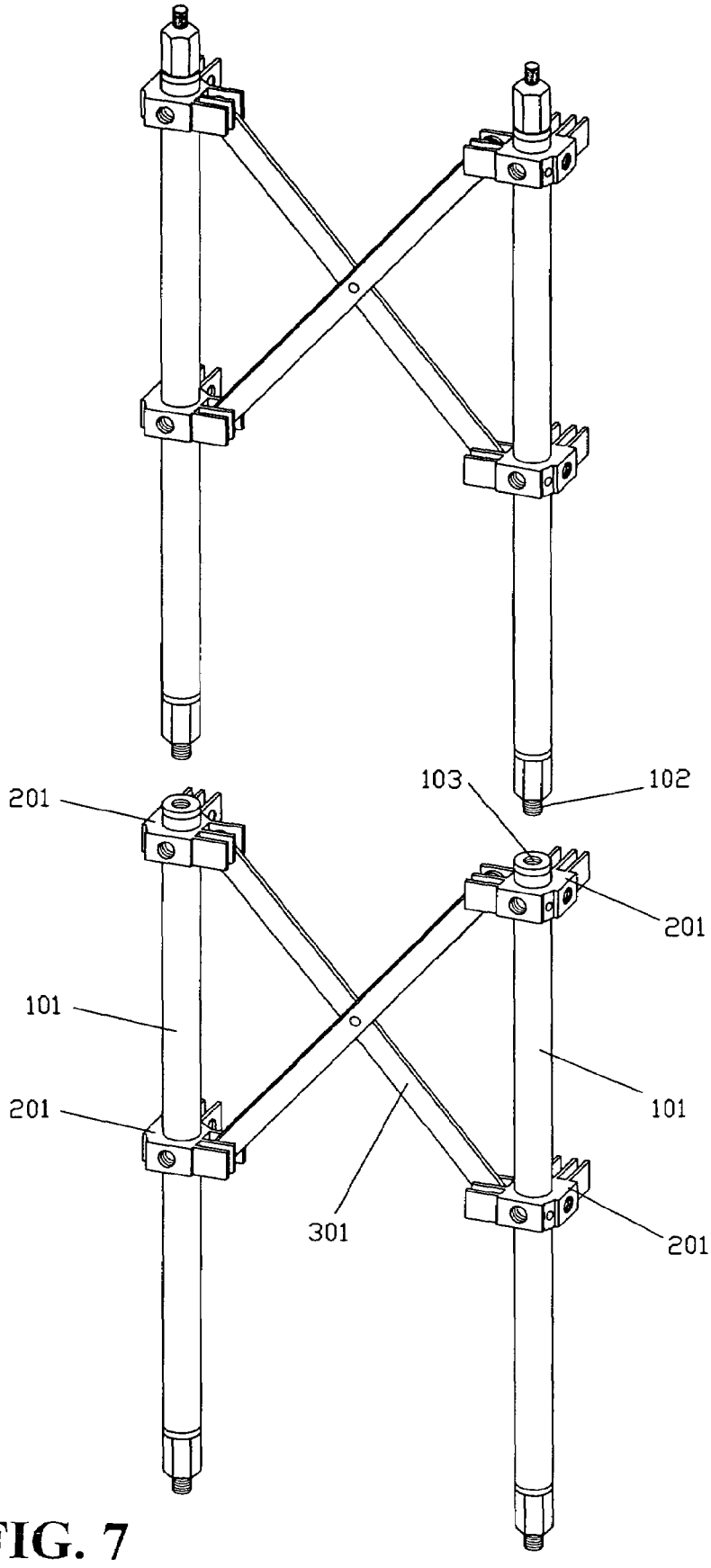
FIG. 7 is a view showing the assembly of expanded main beams of the present invention.

FIG. 2 and FIG. 3 demonstrate the assembled main beams 101 can be put in a closed narrow structure as a result of the pivotal connecting construction of the diagonal support beams 301 for transportation and storage. In actual application, the user can open the two diagonal support beams 301 to place the main beams 101 at desired spacing. As shown in FIG. 2 and FIG. 7, user can add the basic constructions in both horizontal and vertical direction with fastening bolt 102 and threaded insert 103 attached to the end of the main beam 101. Or as shown in FIG. 4 and FIG. 8, the main beam 101 can also be added in desired angle using a ball-shaped extension socket 401.

Figure 8:
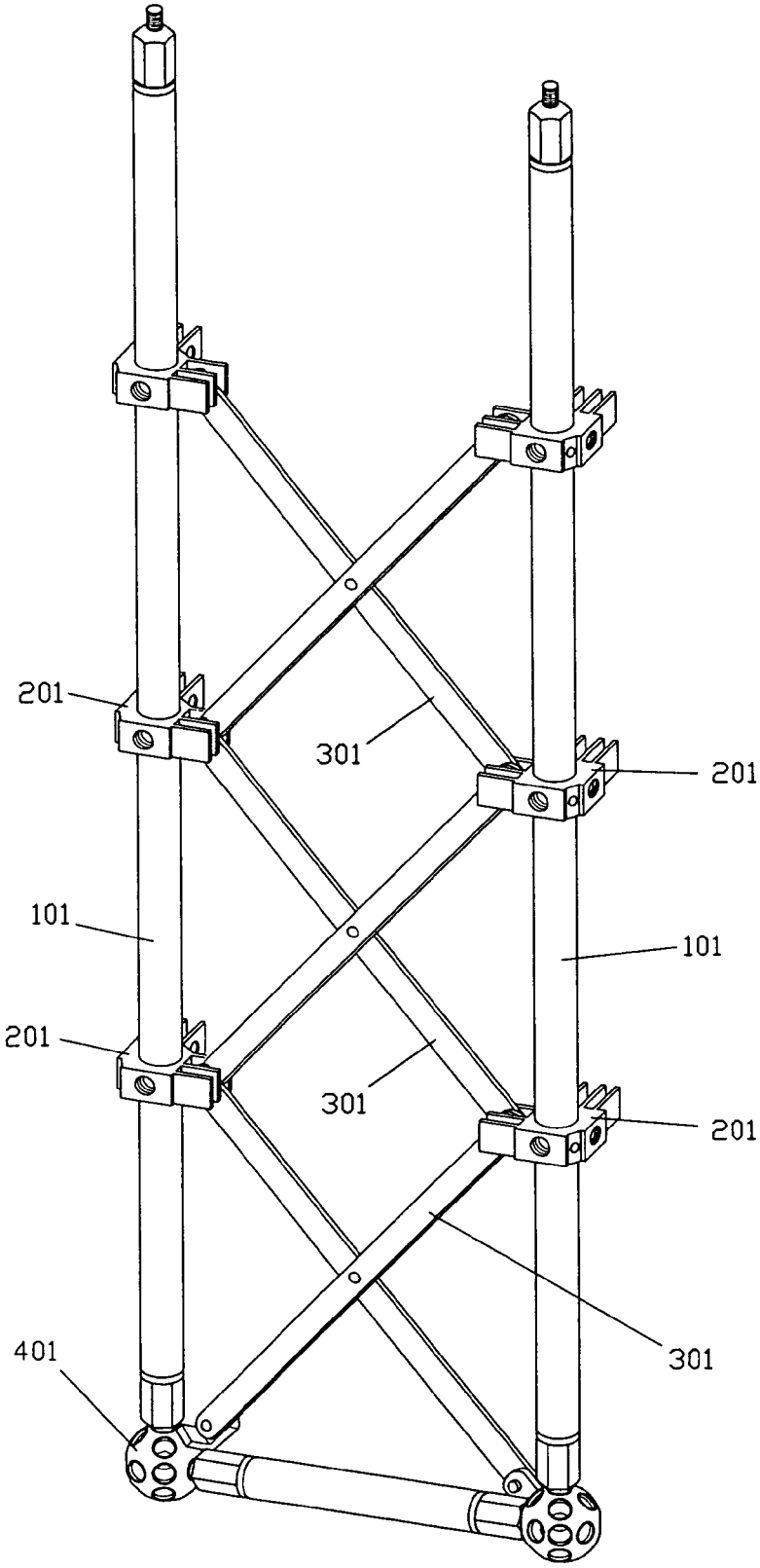
FIG. 8 is a view showing the installation of two sets of diagonal support beams on the same connecting socket of the present invention.

As shown in FIG. 1 and FIG. 8, fins 204 and slots 205 on connecting sockets 201 can accommodate installation of several sets of the diagonal support beams 301 on one main beam 101, thereby increasing the strength of the structure.

Figure 9:
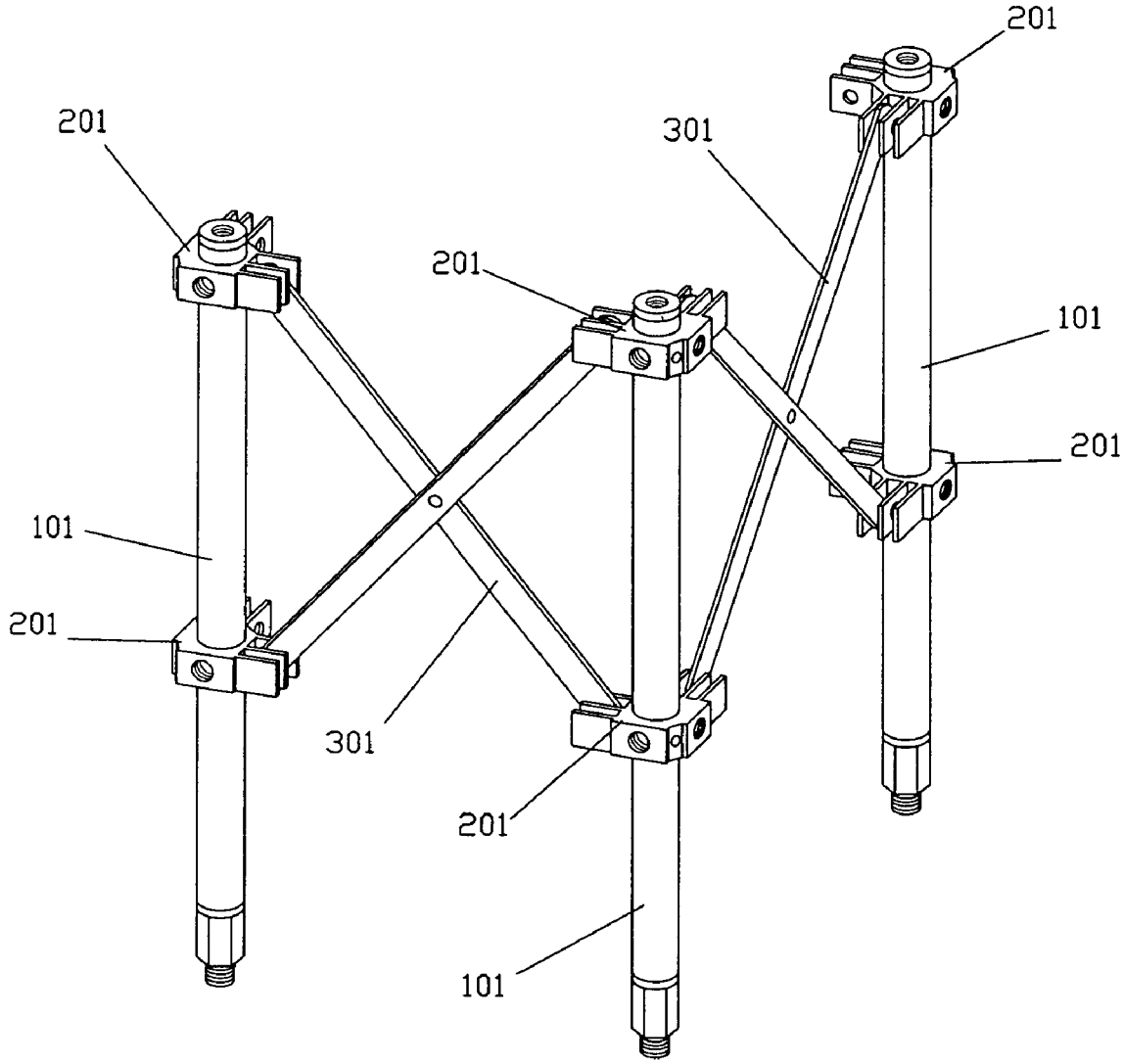
FIG. 9 is a view showing the present invention in the configuration of two sets of main beams with support beams attached.
Figure 10:
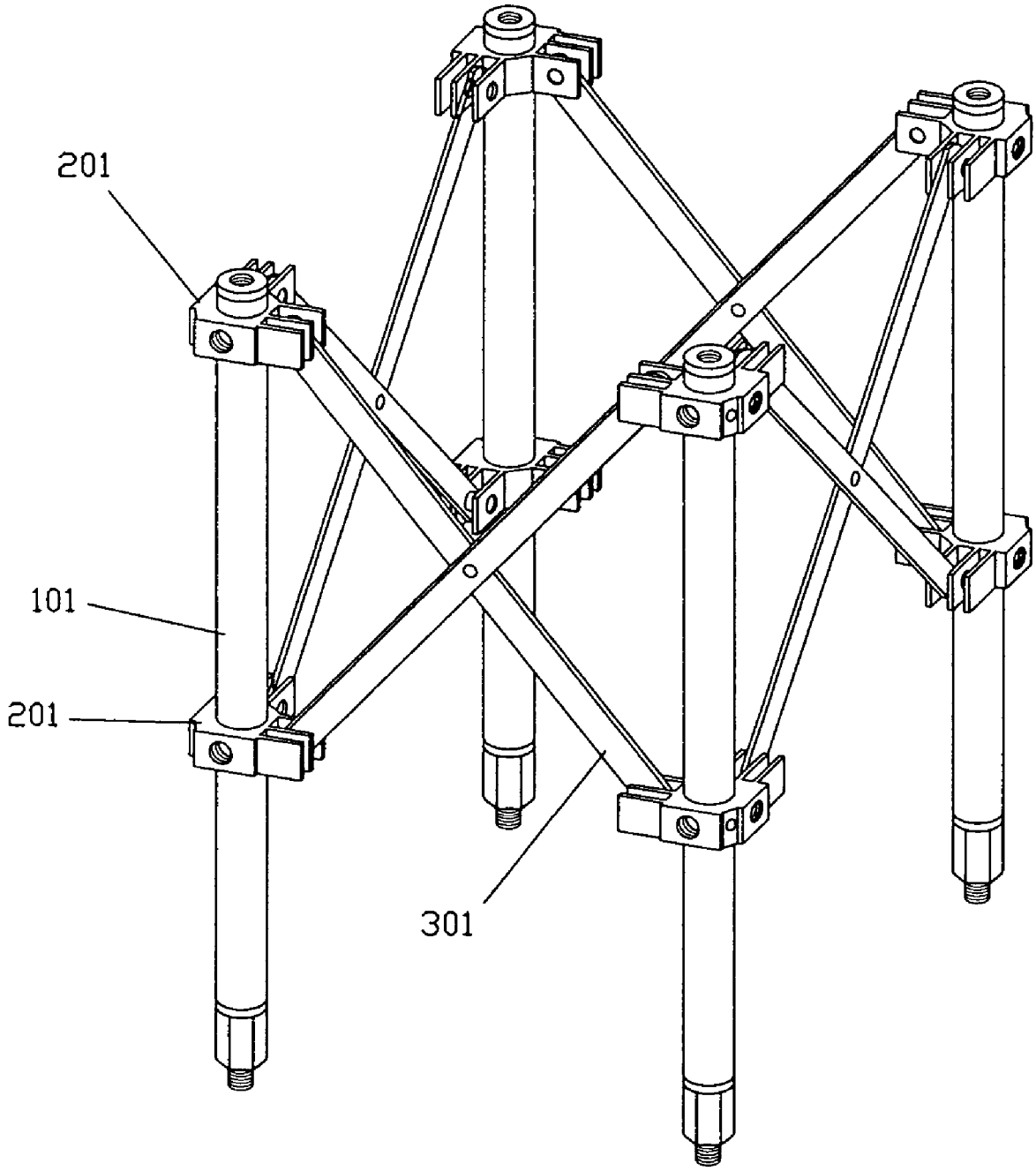
FIG. 10 is a second view showing the present invention in the configuration of two sets of main beams with support beams attached.

The flexibility of this new embodiment described herein offers triangular as well as rectangular shaped construction as shown in FIG. 9 and FIG. 10 respectively.

Figure 5:
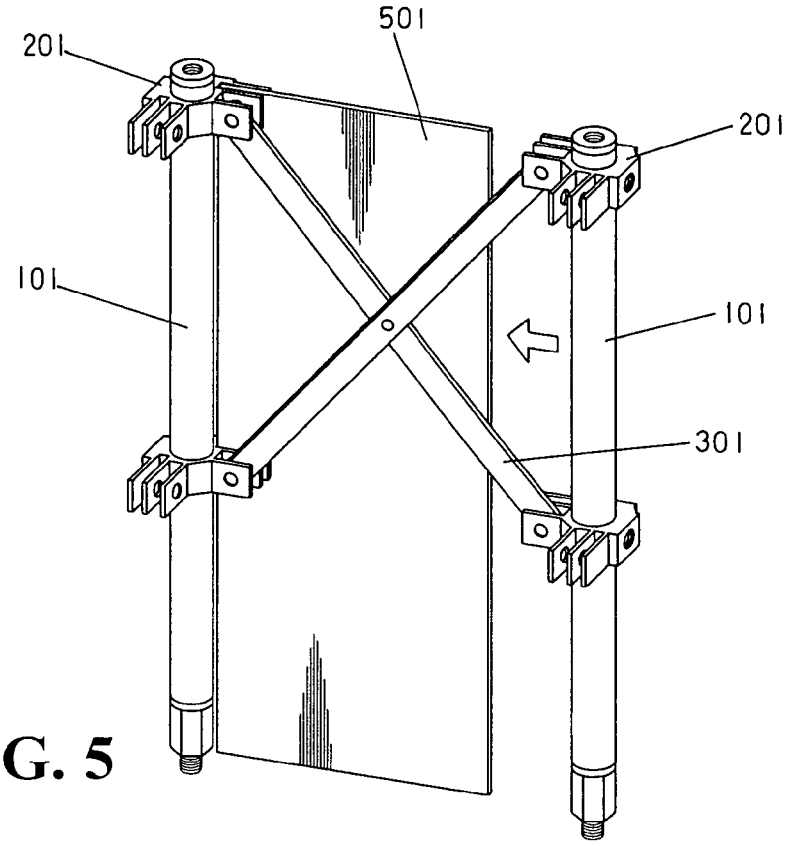
FIG. 5 is a view showing the assembling of face plates of the present invention.
Figure 6:
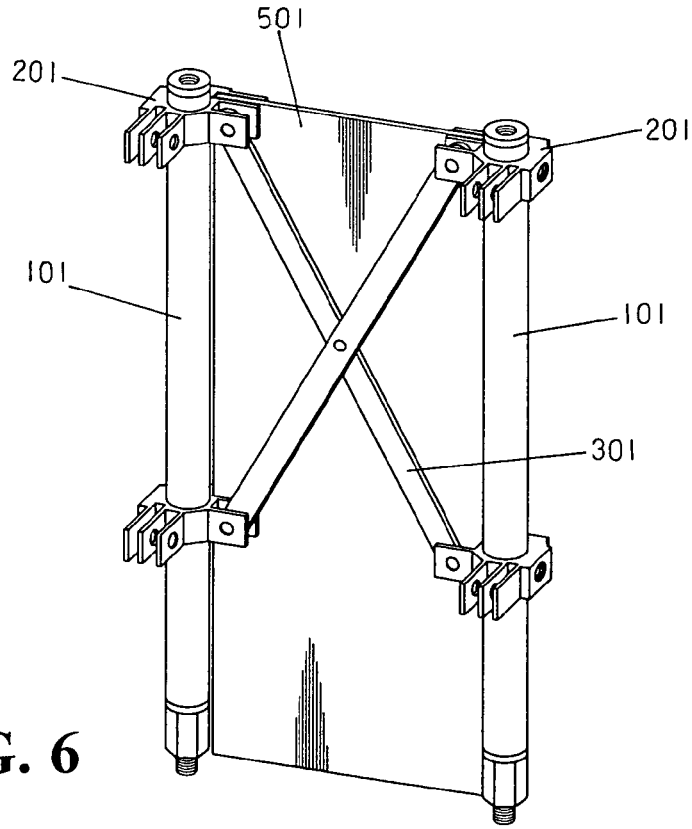
FIG. 6 is a view showing after the assembly of face plates of the present invention.
Figure 11:
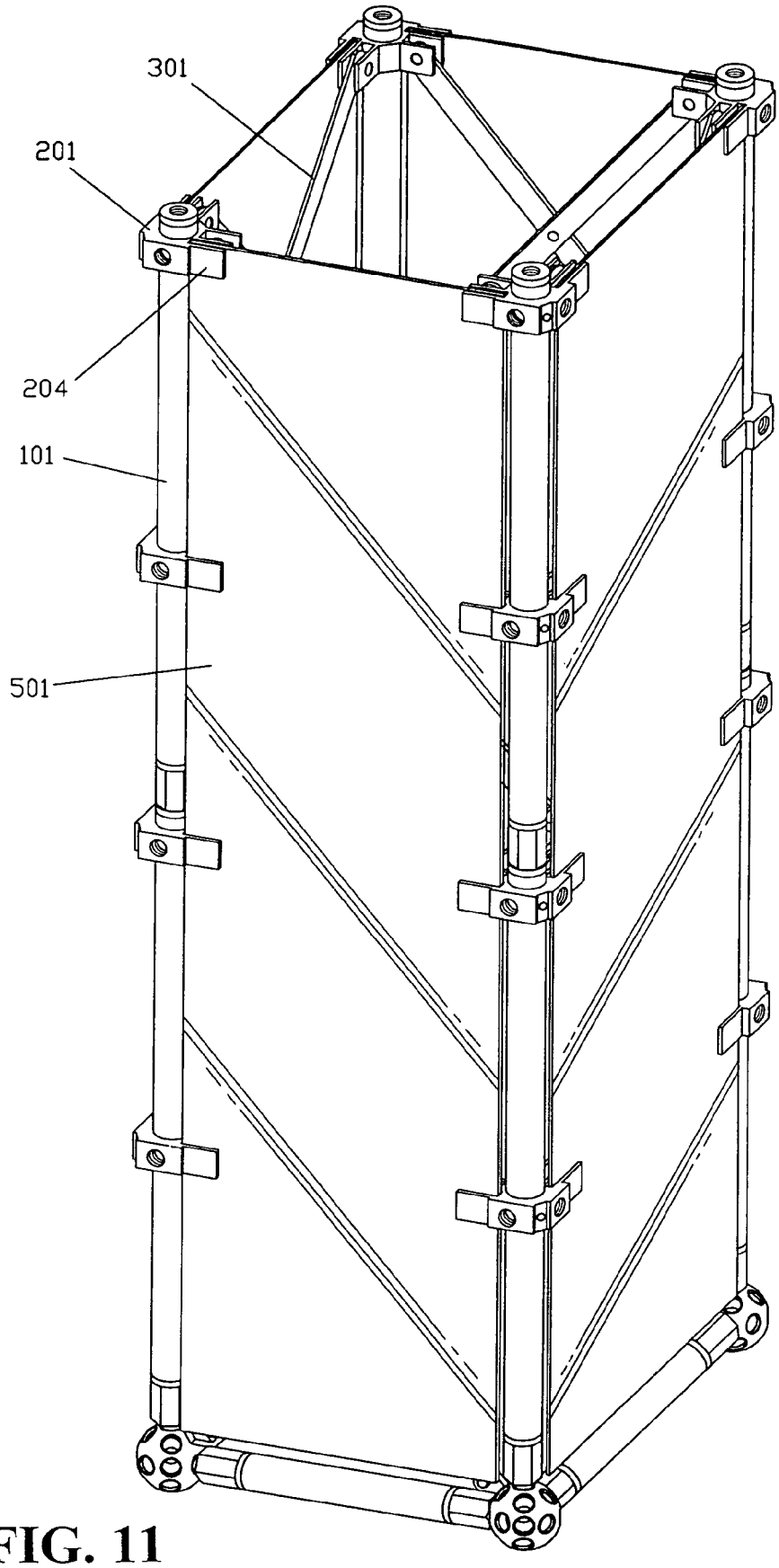
FIG. 11 is a three dimensional view showing a fully assembled embodiment of the present invention.

As shown in FIG. 5, FIG. 6, and FIG. 11, the face plates 501 can be installed between two main beams 101 using the slots 205 on the connecting socket 201. By suitable spacing of two opposite main beams, the structure itself provides force necessary to hold the inserted face plate in place.

Figure 12:
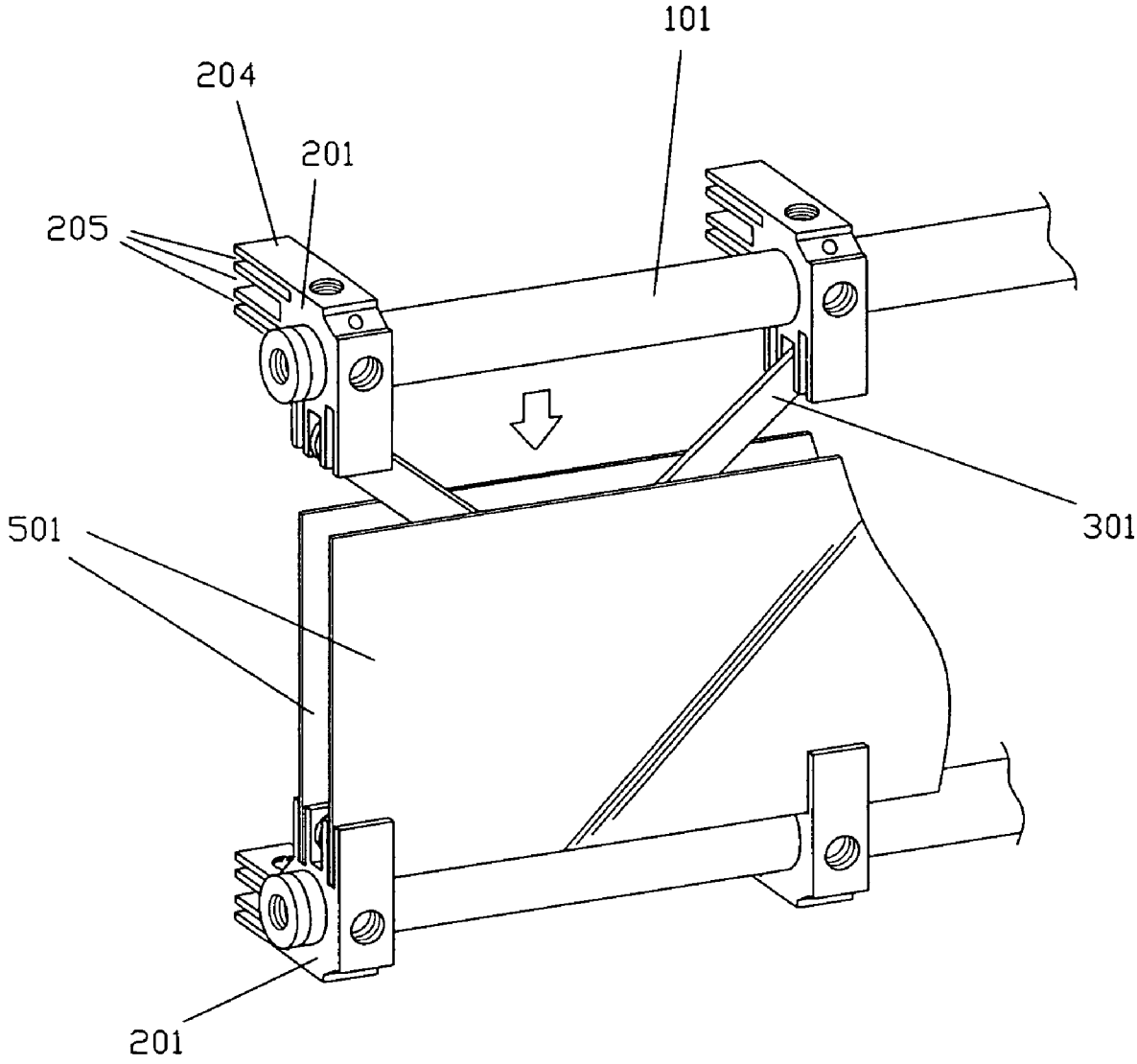
FIG. 12 is a view showing how two face plates are assembled together in the present invention.

Finally as shown in FIG. 12, the U-shape slots 205 formed by fins 204 on the connecting socket 201 can provide connections for both diagonal support beams 301 and face plates 501 onto the main beams 101, The face plates 501 also reinforce the structural stability and strength of the display rack assembled.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

We claim:

1. A structure of a display rack comprising:

a plurality of main beams each having a lower end provided with a fastening bolt and an upper end provided with a threaded insert;

a plurality of diagonal support beams each being a set of two beams pivotally fastened at a center thereof hence enabling said two beams to be in either an open or a close configuration;

a plurality of connecting sockets each having a central insertion hole adapted to engage with a respective end of said main beams, each of said connecting sockets having a fastening hole through which a blind rivet is inserted to fasten said sockets on said main beams, each of said connecting sockets being formed at one side with three fins which form into two first slots and at an adjacent side with three fins which form into two second slots, one of said first slots of said connecting sockets being pivotally connected with a respective end of said diagonal support beams, one of said second slots of said connecting sockets being pivotally connected with a respective end of said diagonal support beams; and a plurality of face plates each fitted between another end of said first slots and second slots of said connecting sockets.

* * * * *